United States Patent [19]

Jennings

[11] Patent Number: 5,036,612

[45] Date of Patent: Aug. 6, 1991

[54] GRIP SAFETY FOR A PISTOL

[76] Inventor: Steven R. Jennings, 8216 Lankershim Blvd. #11, N. Hollywood, Calif. 91605

[21] Appl. No.: 608,174

[22] Filed: Oct. 31, 1990

[51] Int. Cl.[5] ..... F41A 17/24

[52] U.S. Cl. ..... 42/70.08

[58] Field of Search ..... 42/70.01, 70.06, 70.08

[56] References Cited

U.S. PATENT DOCUMENTS

| | | | |
|---|---|---|---|
| 1,085,698 | 2/1914 | Nelson | 42/70.08 |
| 2,691,232 | 10/1954 | Hoopes | 42/70.08 |
| 2,978,826 | 4/1961 | Ivy | 42/70.06 |
| 4,162,586 | 7/1979 | Pachmayr | 42/70.06 |

*Primary Examiner*—Richard W. Wendtland
*Attorney, Agent, or Firm*—Roger A. Marrs

[57] ABSTRACT

A pistol safety catch and release mechanism is disclosed herein for selectively restraining a firing pin in its inoperative position until released by a lever and linkage mechanism operatively mounted in the handgrip of the pistol. In one version, a vertical movable sear is moved into and out of a blocking position with respect to the firing pin that is moved between these positions by the pivotal action of a grip lever pivotally carried at one end to the handgrip. An intermediate link includes a slot through which a pin travels carried on the grip lever causing the intermediate link to pivot. An end of the intermediate link fits into a notch on a slide bar so that the slide bar moves back and forth in response to actuation of the grip lever via the intermediate link. The sear moves to its blocking position when on top of the slide bar while in its non-blocking or release position when occupying an end notch in the slide bar.

6 Claims, 1 Drawing Sheet

GRIP SAFETY FOR A PISTOL

BACKGROUND OF THE INVENTION

1. Field of the Invention

The present invention relates to the field of safety mechanisms for releasably restraining the firing pin of a firearm and more particularly to a novel such mechanism that is operated by a grip lever pivotally carried on the handgrip of a pistol and connected to a firing pin blocking sear by means of a pivotal linkage and slide bar arrangement.

2. Brief Description of the Prior Art

In the past, it has been the conventional practice to provide a releasable safety mechanism for selectively restraining the firing pin of a firearm in a locked position so that inadvertant firing of the firearm cannot take place. Generally, such a safety mechanism includes an element called a sear which moves in and out of a blocking relationship with respect to the firing pin, and the positioning of the sear is usually accomplished by means of a manually slidable or rotatable member carried on the body of the firearm and which incorporates a tab or lug which alternately engages or disengages with the firing pin when manually moved. In this connection, the safety latch or catch is moved usually with the user's thumb whether or not the user's hand is engaged on the pistol in a proper firing position or not. Also, the firearm, such as a pistol, may be in an exposed position with the safety catch in its off condition so that the gun may be inadvertently discharged while the owner of the gun is in the mistaken belief that the safety catch is on.

Therefore, a long-standing need has existed to provide an additional safety feature on a firearm which may be employed in addition to the usual safety catch referred to above but which will operate only when the gun is in the user's hand and preparatory to commencement of firing by the user. Such a device should be coordinated with the hand of the user holding the firearm and should not require separate actuation of safety catches or mechanisms.

SUMMARY OF THE INVENTION

Accordingly, the above problems and difficulties are obviated by the present invention which provides a novel safety mechanism for placing a sear into blocking or unblocking engagement with a firing pin wherein the mechanism includes a lever grip pivotally carried on the handgrip of a pistol and which includes a mechanical linkage operable between the lever grip and the sear for automatically moving the sear to its unblocking position immediately preparatory to the grip charge of the pistol. In one form of the invention, the interconnecting linkage mechanism includes a pivoted intermediate link having a slot in one end receiving an actuating pin carried on the grip lever while its opposite end is inserted into a notch carried on a slide bar lying on a plane horizontal to the plane of the firing pin. One end of the slide bar includes an end notch for receiving the sear when in its unblocked position while a surface edge or shoulder immediately above the end notch supports the sear in its blocking position.

Therefore, it is among the primary objects of the present invention to provide a novel safety mechanism for a firearm which will permit the blocking or unblocking of the firing pin in response to depression of a handle grip lever.

Another object of the present invention is to provide a novel safety mechanism and actuating linkage which is operable upon depression of a lever pivotally carried on the handgrip of a pistol so that the sear is removed from its blocking position with respect to the firing pin preparatory to discharge of the pistol.

Still another object of the invention is to provide a novel safety catch or lock mechanism which is operable in addition to a conventional safety catch on a firearm so that the release of a firing pin is only possible while gripping the pistol handgrip.

BRIEF DESCRIPTION OF THE DRAWINGS

The features of the present invention which are believed to be novel are set forth with particularity in the apended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
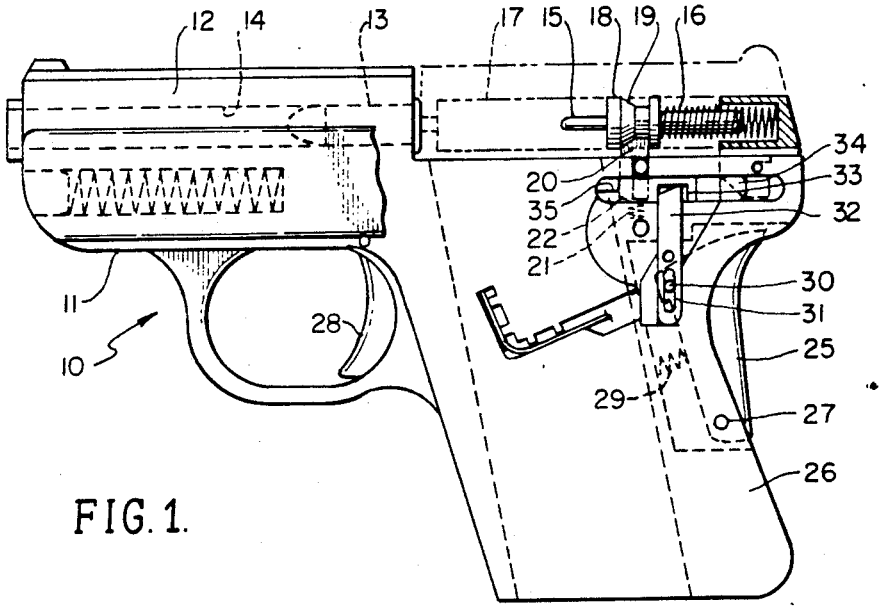
FIG. 1 is a side elevational view, partly in sections, illustrating the novel safety catch mechanism of the present invention.

Referring to FIG. 1, a pistol is indicated in the general direction of arrow 10 which represents a typical firearm having a main body or frame 11 on which a barrel 12 slides reciprocally to open and close a breach for insertably receiving an ammunition magazine carrying a plurality of bullets, such as a bullet indicated by numeral 13 positioned in a firing chamber 14 preparatory for impacting by a firing pin 15.

The firing pin 15 is illustrated in its retracted position in solid lines so that its actuating spring 16 is compressed preparatory for release into the firing position illustrated in broken lines by numeral 17. It is to be particularly noted that the firing pin 15 is carried on the end of a guide 18 which includes an annular depression or groove, indicated by numeral 19. A safety mechanism for retaining the firing pin in its non-operative position preparatory to release includes a lug or sear 20 insertably received into the groove so as to occupy the groove and prevent expansion of spring 16 until the sear has been removed from the groove. The groove is defined by a forward tapered shoulder and a rear annular shoulder formed into the guide 18. The sear 20 is normally biased into the groove by expansion of a compression spring 21 which is compressed between the bottom of an opening in the frame 11 and the underside of a sear element 22. These components are more clearly shown in FIG. 3.

The sear 20 is moved in and out of the annular groove of the firing pin guide by means of a linkage mechanism connected to the trigger 28. However, this cannot be accomplished until the slide bar 34 is placed in its most rearward position by means of the grip safety which comprises a grip lever 25 pivotally mounted to the pistol grip 26 by means of a pivot 27. When the user's hand grasps the pistol grip 26, his hand will depress the lever 25 about pivot 27 when his index finger squeezes a trigger 28. The pivot 25, when pivoted into the grip 26, compresses an expansion spring 29 which normally urges the grip lever 25 outwardly so that a portion of the lever is exposed beyond the edge marginal region of the pistol grip 26. The end of the grip lever 25 opposite its end pivotally mounted to the pistol grip 26 includes an outwardly projecting pin 30 which rides within a slot 31 provided in an intermediate link 32. The intermediate link 32 is pivotally carried on the frame or body of the pistol and the opposite end of its end carrying the slot includes a portion 32 that projects into a notch 33 carried on the midsection of a slide bar 34. An extreme end of the slide bar includes a notch 35 that lateral retainers 36 will drop into when the sear is removed from the annular groove.

Figure 2:
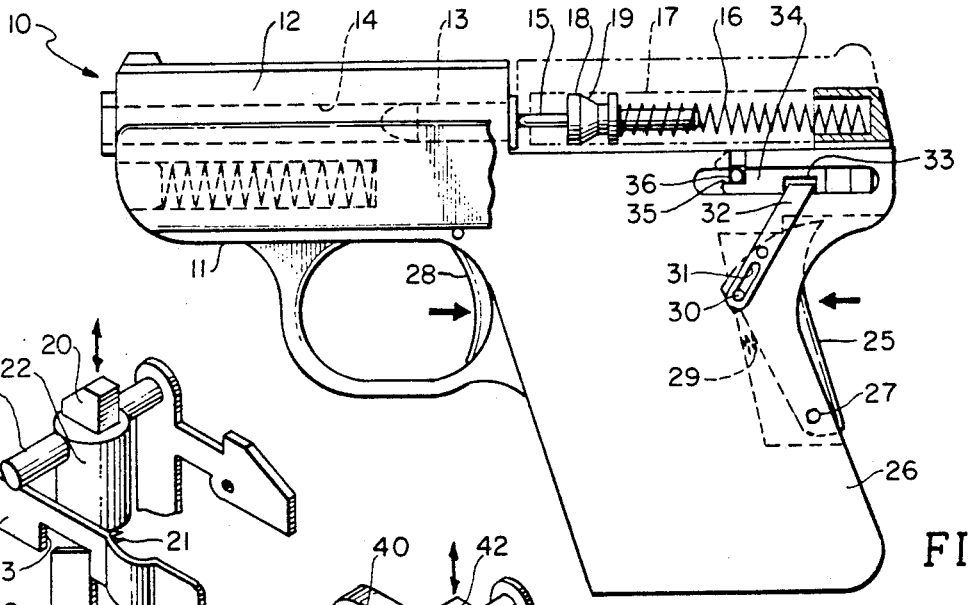
FIG. 2 is a view similar to the view of FIG. 1 illustrating the safety catch mechanism in its release position permitting expansion of the firing pin.
Figure 3:
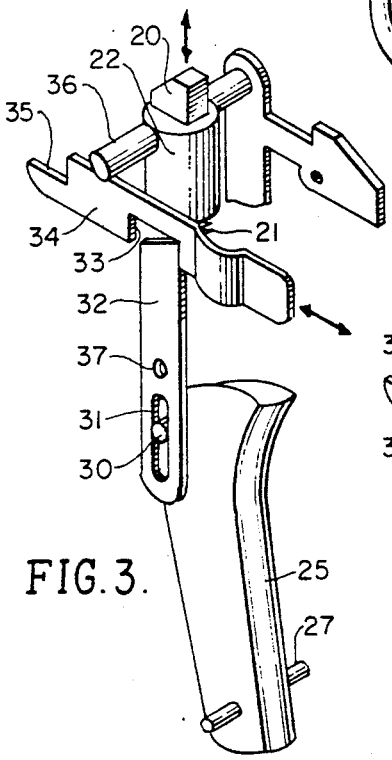
FIG. 3 is a perspective view showing the mechanism and linkage components comprising the novel invention.

Therefore, it can be seen that as the intermediate link 32 is pivoted about its pivot broadly indicated by numeral 37 in FIG. 3, the slide bar 34 will move back and forth under the lateral pin 36. When the slide bar is in its rearmost position, as shown in FIG. 2, the lateral pin 36 will drop into the notch 35 and the firing pin will be prepared for release.

Referring to FIG. 2, the safety mechanism is illustrated in its released condition. This is a condition where the user's hand is on the hand grip 26 and his index finger is pressing against the trigger 28 in the direction indicated by the arrow. When this happens, the palm of the user's hand presses against portion 25 of the grip lever causing the grip lever 25 to pivot about pivot 27. The pivoting action compresses the expansion spring 29 and causes pin 30 to ride within the slot 31 on the intermediate lever 32. Such movement pivots the intermediate lever 32 so that its end opposite to its end carrying the slot 31 rides within notch 33 of the slide bar 34 so that the slide bar is positioned to its rear position, as illustrated. The slide bar is now in a position where the notch 35 is immediately under the pins 36 carried on the sear 20 so that the sear can be moved downwardly into the notch 35. Such action releases the guide 18 so the firing pin 15 can move forwardly under the expansion of the helical spring 16.

Figure 4:
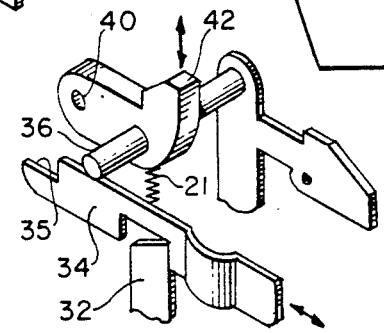
FIGS. 4 and 5 illustrate alternate versions of the invention and the views are similar to the view of FIG. 3.
Figure 5:
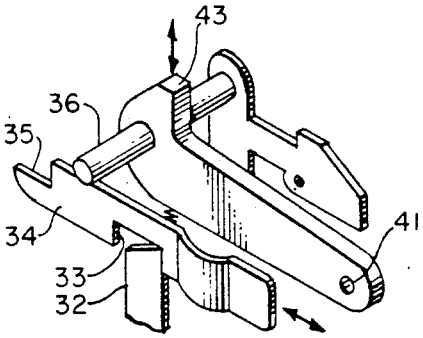

FIG. 3 illustrates the safety link mechanism. However, FIGS. 4 and 5 further illustrate the identical mechanism except that the sear takes a different configuration. Instead of the sear moving up and down, the sear is mounted on a pivot, such as indicated by pivot 40 in FIG. 4 and pivot 41 in FIG. 5. The sears in FIGS. 4 AND 5 are illustrated by numerals 42 and 43 respectively. These sears include the laterally extending ends 36, as previously described with respect to the embodiment shown in FIGS. 1–3 inclusive.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A safety mechanism for a firearm comprising:

a firearm body having a handgrip with an edge marginal region;

a grip lever pivotally carried on said handgrip and having a portion exposed beyond said edge marginal region of said handgrip;

a sear mounted on said body having an operative raised position and a non-negative lowered position;

linkage pivotally carried on said body interposed between said grip lever and said sear for restricting movement of said sear between said operative and said non-operative positions;

said linkage includes a slide bar having opposite ends and movably carried on said handgrip and having an end notch on one of said opposite ends defined by a shoulder terminating in an upper edge; and said upper edge supporting said sear in its operative position and said end notch receiving said sear in its non-negative position.

2. The invention as defined in claim 1 wherein:

said slide bar includes a lower edge having a central notch midway between its opposite ends for insertably receiving a selected end of said pivotal linkage.

3. The invention as defined in claim 2 wherein:

said linkage includes an intermediate link pivotally carried on said body movable in response to said grip lever to translate pivotal movement of said grip lever to rectilinear movement of said slide bar.

4. The invention as defined in claim 3 wherein:

said body includes a pivotal trigger carried on said handgrip whereby said trigger and said grip lever pivot in unison when gripped by the hand of the user.

5. The invention as defined in claim 4 wherein:

said intermediate link includes an elongated slot; and said grip lever having a fixed pin slidably received into said intermediate link elongated slot effective to rotate said intermediate link in response to pivoting of said grip lever.

6. The invention as defined in claim 5 wherein:

said firearm is a pistol having a firing pin in alternate positions of ready to fire position and fire position;

said sear in its operative position to releasably maintain said firing pin in its ready to fire position and in its non-operative position in said fire position.

* * * * *